US006606847B2

(12) United States Patent
Ludvíček et al.

(10) Patent No.: US 6,606,847 B2
(45) Date of Patent: Aug. 19, 2003

(54) METHOD OF SPINNING-IN YARN ON AN OPERATING UNIT OF A ROTOR SPINNING MACHINE AND A DEVICE FOR CARRYING OUT THE METHOD

(75) Inventors: Josef Ludvíček, Ústí nad Orlicí (CZ); Pavel Kousalik, Ústí nad Orlicí (CZ); Jaroslav Markl, Chodská (CZ); Tomáš Tesař, Ústí nad Orlicí (CZ)

(73) Assignee: Rieter CZ A.S., Usti nad Orlici (CZ)

( * ) Notice: Subject to any disclaimer, the term of this patent is extended or adjusted under 35 U.S.C. 154(b) by 0 days.

(21) Appl. No.: 09/911,075

(22) Filed: Jul. 23, 2001

(65) Prior Publication Data

US 2002/0046557 A1 Apr. 25, 2002

(30) Foreign Application Priority Data

Jul. 26, 2000 (CS) ..... PV 2000-2735

(51) Int. Cl.[7] ..... D01H 4/50

(52) U.S. Cl. ..... 57/263; 57/264; 57/300; 57/302; 57/303; 57/304; 57/404

(58) Field of Search ..... 57/261, 263, 264, 57/300–304, 400, 404, 405, 407, 408, 415

(56) References Cited

U.S. PATENT DOCUMENTS 4,893,462 A * 1/1990 Braun et al. ..... 57/263
5,535,580 A 7/1996 Sebastian et al.
5,640,839 A * 6/1997 Novotny et al. ..... 57/263

FOREIGN PATENT DOCUMENTS

WO 9836115 8/1998

* cited by examiner

*Primary Examiner*—John J. Calvert
*Assistant Examiner*—Shaun R Hurley
(74) *Attorney, Agent, or Firm*—Dority & Manning

(57) ABSTRACT

A method of spinning-in yarn on an operating unit of a rotor spinning machine includes steps of yarn preparation for spinning-in, steps of spinning rotor preparation for spinning-in, and final spinning-in steps. The final spinning-in steps include at least the beginning of the sliver supply to the singling-out device, leading of the fibers from the singling-out device away from the spinning rotor for a predetermined time interval, letting the spinning-in yarn end get into contact with the collecting groove of the spinning rotor, and starting of the yarn draw-off and winding. At least some final spinning-in steps are time synchronized in relation to the closing of the spinning unit thus obtaining optimum piecer quality repeatedly at all operating units of the machine.

11 Claims, 4 Drawing Sheets

METHOD OF SPINNING-IN YARN ON AN OPERATING UNIT OF A ROTOR SPINNING MACHINE AND A DEVICE FOR CARRYING OUT THE METHOD

TECHNICAL FIELD

The invention relates to a method of spinning-in yarn on an operating unit of a rotor spinning machine which comprises steps of yarn preparation for spinning-in, steps of spinning rotor preparation for spinning-in, and final spinning-in steps. The steps of yarn preparation for spinning-in comprise at least the detection of the yarn end on the bobbin or the preparation of auxiliary yarn when spinning-in on an empty tube, unwinding and metering a yarn length required for spinning-in, setting the yarn into its spinning-in position on the operating unit of the rotor spinning machine in which the yarn is outside the reach of the yarn distributor and not clamped between the rollers of the draw-off mechanism, creating the spinning-in yarn end and introducing it into the yarn delivery tube from the spinning rotor. The step of the spinning rotor preparation for the spinning-in comprise at least the opening of the spinning unit, cleaning of the spinning rotor, closing of the spinning unit. The final spinning-in steps comprise at least the beginning of the sliver supply to the singling-out device, leading of the fibres from the singling-out device away from the spinning rotor for a predetermined time interval, bringing the spinning-in yarn end into contact with the collecting groove of the spinning rotor and starting of the yarn draw-off and winding.

The invention also relates to a device for carrying out the yarn spinning-in on a rotor spinning machine wherein each operating unit comprises a spinning unit with a cover adapted to be opened for gaining access to the spinning rotor for its cleaning.

TECHNICAL BACKGROUND

Depending on the method of the yarn spinning-in, rotor spinning machines are divided into two groups, and more exactly, into machines with manual spinning-in and machines with automated spinning-in by means of an attending device traveling along the operating units of the machine.

Rotor spinning machines with manual spinning-in are equipped with an auxiliary spinning-in device on each operating unit so that the operator carries out only the steps of yarn preparation for the spinning-in and cleaning of the spinning rotor including the opening and closing of the spinning unit and introducing the spinning-in yarn end into the yarn delivery tube. In former machine types, the operator manually lets the spinning-in yarn end sink onto the collecting groove and manually sets in action the auxiliary spinning-in device which then mechanically or electrically actuates the sliver feed, yarn draw-off and yarn winding on the bobbin.

In more modern machine types, the operator carries out manually the same steps as in the former machine types except the sinking of the spinning-in yarn end on the collecting groove of the spinning rotor. The operator just introduces the spinning-in yarn end into the yarn delivery tube and prepares the yarn into the preparatory position for spinning-in in which the spinning-in yarn end is held by adequate means of the operating unit of the machine ready to be sunk onto the collecting groove of the spinning rotor. As disclosed in CZ 284295 B5, at each operating unit the arms of the winding device and the pressure lever of the delivery device are coupled with a control electromagnet interconnected with a control unit which is coupled also with a deflecting member intended to deflect the yarn from its operative course and to sink the spinning-in yarn end onto the collecting groove of the spinning rotor, with a sliver feeding device, and with a monitor for testing the quality and/or the presence of the yarn. At a command given by the operator, the control unit sets in mutually timed action all the above spinning-in means of the operating unit. This device has led to a substantial improvement in the piecer quality since the spinning-in operations proper are carried out by the means of the operating unit of the machine with elimination of the operator's influence.

In spite of the considerable improvement in the quality, neither the size nor the strength of the piecers is constant, and the final yarn producers are interested in improved piecer quality.

In automated spinning machines, the attending device is responsible for all steps connected with the resumption of the spinning-in process. The timing of the individual steps of the attending device is controlled electronically and the start moment of each spinning-in step can be within certain limits modified as needed.

To increase the piecer quality, automatic spinning machines are equipped with an attending device controlled means for delivering the sliver from the singling-out device away from the spinning rotor before the spinning start. The means for the sliver delivery from the singling-out device away from the spinning rotor can contain pressure air supply from the attending device acting onto the circumference of the rotating combing roller of the singling-out device as described in CZ 280036 or sucking off of the fibres from the singling-out device behind the channel for fibre supply into the spinning rotor controlled and carried out by the attending device, as described in the CZ patent application 1995-255 and U.S. Pat. No. 5,535,580.

Automated rotor spinning machines give good piecer quality but the attending devices are very complicated and expensive and each highly productive machine requires a number of them which complicates the attendance and further increases the purchase cost.

The invention aims at reducing the attendance time required for the spinning-in operation on an operating unit.

SUMMARY OF THE INVENTION

Objects and advantages of the invention will be set forth below in the following description, or may be obvious from the description, or may be learned through practice of the invention.

The increase in the piecer quality and the reduction of the attendance time required for the spinning-in operation on an operating unit is obtained by the method according to the invention whose principle consists in that at least some of the final spinning-in steps are timed in relation to the closing of the spinning unit thus obtaining optimum piecer quality repeatedly at all operating units of the machine In manually operated machines, the method according to the invention eliminates the operator's intervention into the process proper of attaching the yarn at the resumption of spinning and permits exactly the synchronization (timing) of the final spinning-in steps, this timing being on all operating units repeatedly (invariably) the same. In automated rotor spinning machines, this method permits reduction of the attendance interval of the attending device.

According to the specific technological requirements of a given case, imposed either by the machine or by the yarn in question, the timing can be carried out in relation to the moment when the closing of the spinning unit has ended, has begun, or has reached a predetermined moment in the course of the closing operation of the spinning unit.

The choice of a suitable beginning of the timing of the final spinning-in steps and the possibility of combining the timing moments for the individual specific final spinning-in steps increase the variants of use of the method according to the invention.

To realize the method according to the invention, it is advantageous if, depending on the beginning of the closing of the spinning unit, the yarn delivery from the singling-out device away from the spinning rotor starts first followed in timed relation to the completed closing of the spinning unit by the beginning/start of the sliver feed into the singling-out device, the termination of the yarn deflection outside/away from the spinning rotor, letting the spinning-in yarn end come onto the collecting groove of the spinning rotor, and starting the yarn delivery and winding.

The yarn delivery during the closing process of the spinning unit prior to the spinning rotor start appears to be the most favourable variant.

The start of the fibre delivery prior to the closing of the spinning unit and prior to the start of further final spinning-in steps will ensure that no fibres or impurities enter the spinning rotor prior to the spinning-in, and the following timing of further final spinning-in steps in relation to the completed closing of the spinning unit ensures repeatedly (invariably) constant condition for spinning-in on all operating units while the moment of the sliver feed start, that of the termination of the fibre delivery from the singling-out device outside the spinning rotor, that of letting the spinning-in yarn end come onto the collecting groove of the spinning rotor, and that of the yarn winding can be to a required extent adjusted in accordance with the specific technological requirements imposed upon the yarn being spun.

In particular, in manually attended machines with manual closing of the spinning unit, it is advantageous if the steps of the yarn preparation for spinning-in and the steps of the spinning rotor preparation including the closing of the spinning unit are carried out manually whereas the final spinning-in steps, synchronized in relation to the closing process of the spinning unit, are carried out by the means of the operating unit of the machine and are started by the closing process of the spinning unit.

In another variant of the method according to the invention, it is advantageous if the steps of the yarn preparation for spinning-in and the steps of the spinning rotor preparation for spinning-in, except the closing of the spinning unit and the final spinning-in steps, are carried out by the means of the operating unit of the machine, the closing process being initiated by an operator's command, and the final spinning-in steps by the closing process of the spinning unit. This enables the manually attended machines to reach the piecer quality equal or even superior to that of present-day automated machines since the means of the attending device in many cases fail to ensure a perfect fibre delivery from the singling-out device outside the spinning rotor prior to the closing of the spinning unit.

In automated rotor spinning machines, it is advantageous to use the means of the attending device for carrying out the steps of the yarn spinning-in, including the closing process of the spinning unit, and the means of the operating unit of the machine, for carrying out the final spinning-in steps initiated by the closing process of the spinning unit.

In another variant of the method suitable for automated rotor spinning machine, the means of the operating unit of the machine carry out the spinning-in preparatory steps both of yarn and of the spinning rotor except the closing or, as the case may be, also the opening of the spinning unit, as well as the final spinning-in steps, the closing process of the spinning unit being initiated by a command from the attending device, and the timed (synchronized) spinning-in steps being initiated by the closing process of the spinning unit.

In automated rotor spinning machines, this solution permits reduction of the attendance time interval required for the spinning-in operation at an operating unit since the attending device can leave the operating unit being attended, in the first variant after the completed closing of the spinning unit, and in the second variant after the beginning of the closing process of the spinning unit initiated by it (by the attending device). Besides the reduction in the length of the attending time, the attending device is rendered simpler and cheaper, and the piecer quality is superior to that reached by some attending devices, since optimum conditions of fibre delivery from the singling-out device outside the spinning rotor prior to the completed closing of the spinning unit, i.e., prior to the rotor rotation start can be ensured in every case.

DESCRIPTION OF THE DRAWINGS

Examples of an embodiment of the rotor spinning machine according to the invention are schematically shown in enclosed drawings in which.

DESCRIPTION OF EXAMPLES OF AN EMBODIMENT

Figure 1:
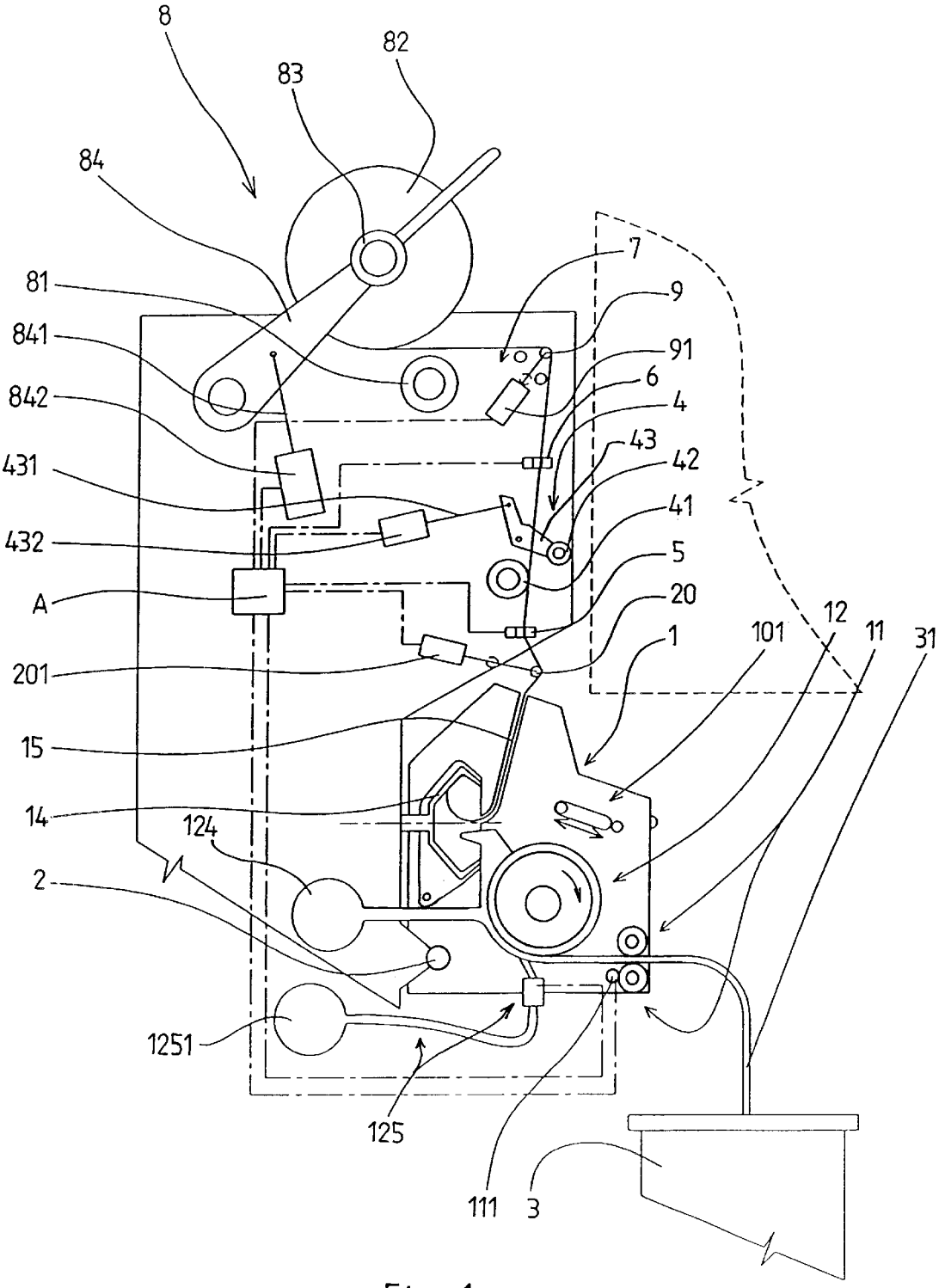
FIG. 1 is the arrangement of an operating unit of a semi-automatic rotor spinning machine, FIG. 2 a detail of the spinning unit in closed position, FIG. 3 a detail o a tilted away (opened) spinning unit in the cleaning position.
Figure 2:
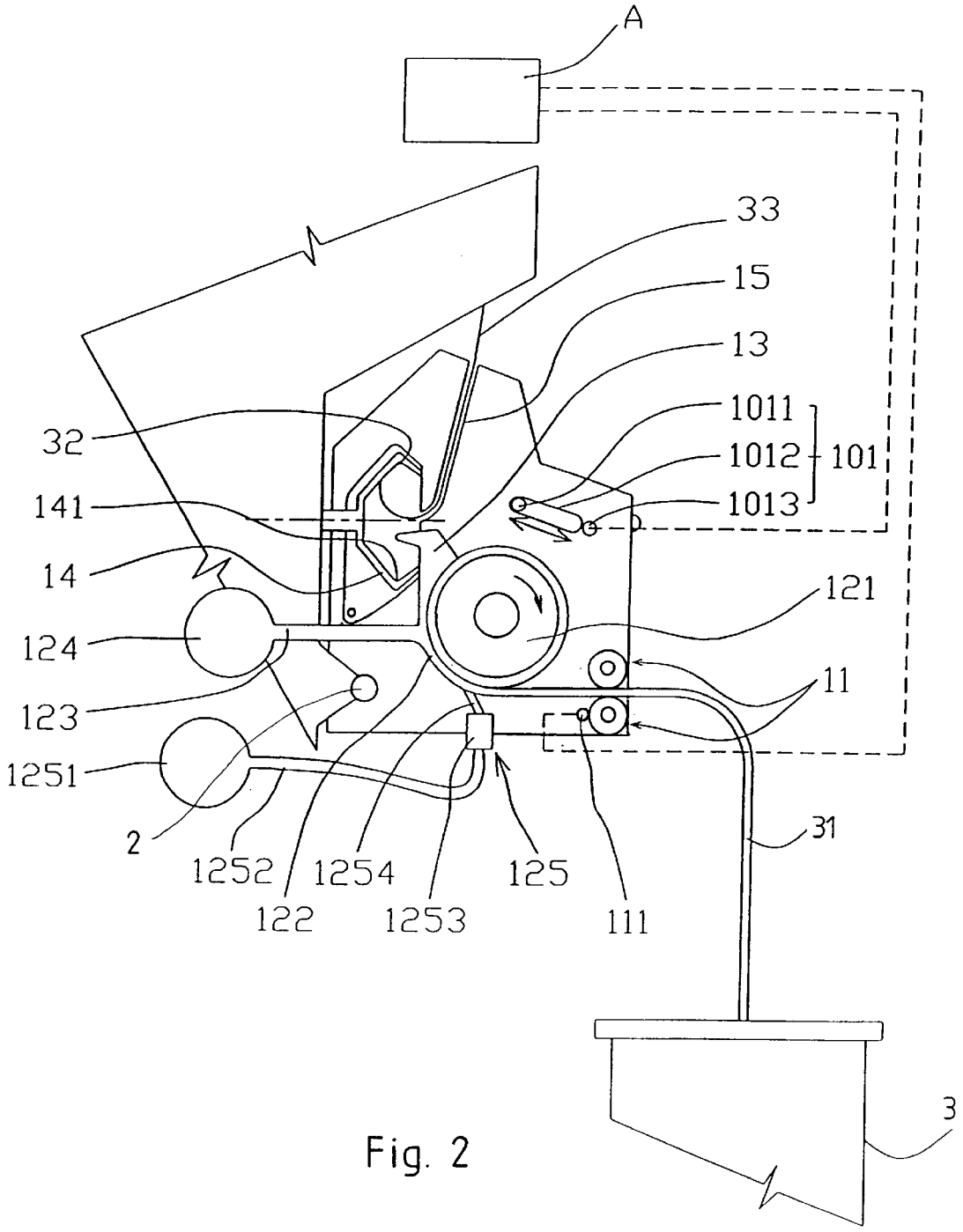

The rotor spinning machine comprises a number of operating units arranged next to each other, each of which produces yarn from a textile fibre sliver and winds the produced yarn on a bobbin. The rotor spinning machine can be fully automated or semi-automatic or manually attended.

A fully automated rotor spinning machine is fitted with an attending device seated and adapted to travel along the operating units of the rotor spinning machine and fitted with means for carrying out attending operations on the operating unit in resuming the spinning and/or doffing wound bobbins and replacing them by empty tubes.

A semi-automatic rotor spinning machine is partly attended manually, partly fitted with means for spinning-in automation used to carry out final spinning-in steps.

Each operating unit of a semi-automatic rotor spinning machine comprises a spinning unit 1 mounted and adapted to pivot in a well-known manner on a pin 2 mounted in the machine frame. A can 3 with sliver 31 is situated under the spinning unit 1. Situated at the inlet into the spinning unit 1 is a feeding device 11 of the sliver 31 comprising a feed roller detachably coupled in a well-known manner with a drive, for instance by means of an electromagnetic clutch 111 or by means of a step motor. The electromagnetic clutch 111 is connected by a line with a control unit A. The feeding device 11 receives the sliver 31 from the can 3.

The feeding device 11 is followed by a singling-out device 12 containing a combing roller 121 with a circumferential channel 122 for feeding singled-out fibres whose operative section reaches from the mouth of the feeding device 11 to a singled-out fibres supply channel 13 leading the fibres into a spinning rotor 14. An impurity removal channel 123 entering an underpressure channel 124 derives at a suitable place from the operative section of the circumferential channel 122.

The singling-out device 12 has also related thereto a device 125 for delivering fibres from the circumferential channel 122 of the singling-out device outside (away from) the spinning rotor 14 which in the shown example contains a pressure air source 1251 made in the shown embodiment as an overpressure pipe-line laid along the machine length side and connected with well-known not represented pressure air reservoir. Each operating unit of the machine is connected with the pressure air source 1251 by means of a pressure line 1252 consisting at least partly of a pressure hose. The pressure line 1252 is connected to the input of a closing means 1253 such as an electromagnetic valve seated on the spinning unit 1 and connected by an auxiliary supply channel 1254 with the operative section of the circumferential channel 122 of the singling-out device. The closing means 1253 of the auxiliary supply channel 1254 of pressure air is interconnected with the control unit A.

In another, not illustrated embodiment, the device 125 for delivering fibres from the the circumferential channel 122 of the singling-out device outside the spinning rotor 14 consists of an auxiliary delivery channel following the circumferential channel 122 and by a well-known closing means connected to an underpressure source of the machine. Also in this embodiment the closing means is connected with a control unit serving at least to control the spinning-in on the operating unit in question.

Figure 3:
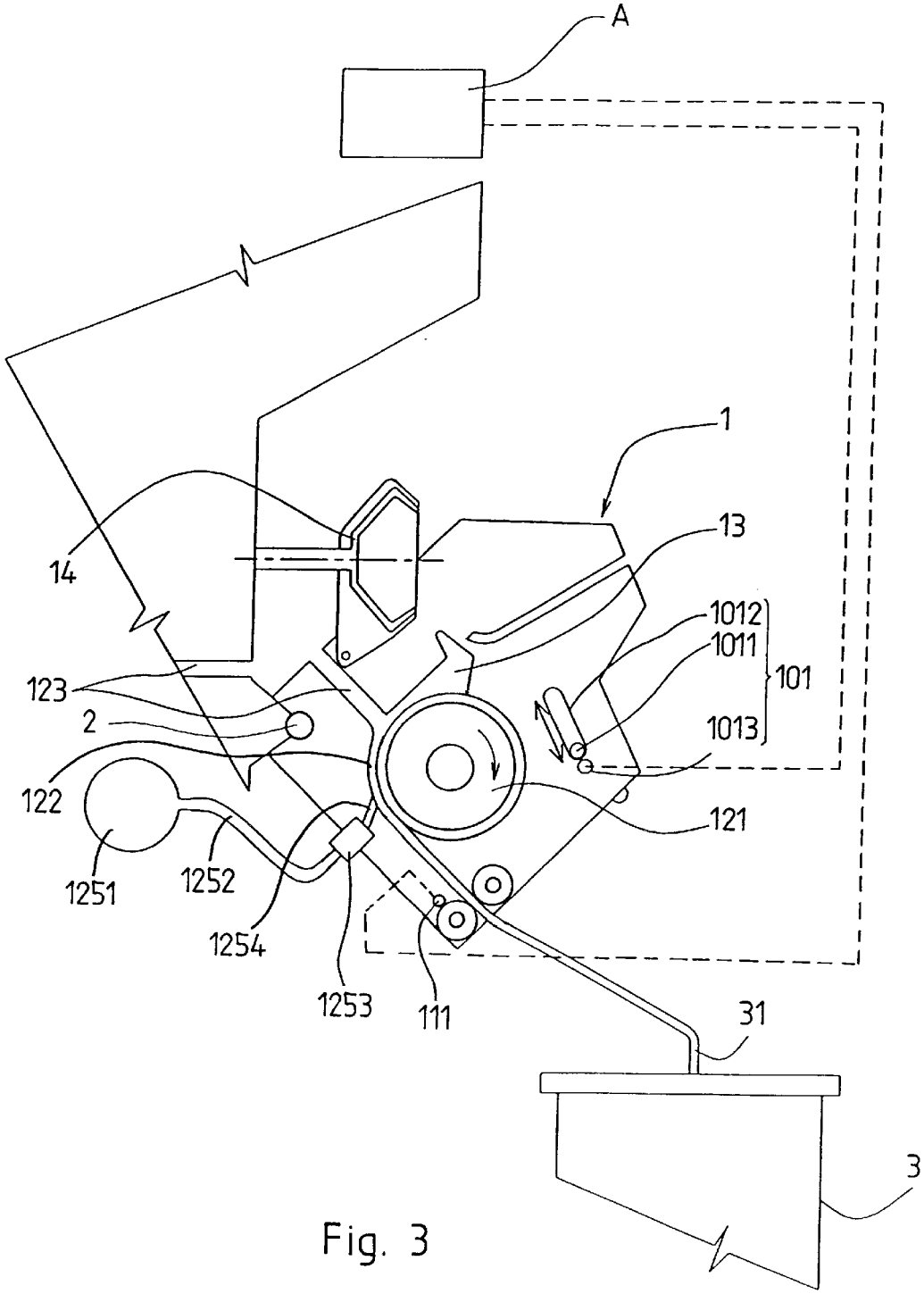

Mounted on the spinning unit 1 is a sensor 101 for monitoring the position of the pivotably mounted spinning unit 1 and interconnected with the control unit A used to control its related operating unit of the machine. In the shown example, the sensor 101 consists of a moving permanent magnet 1101 seated in labyrinth 1012 and of a reed contact 1013 which is related to the end of a groove 1012 in which the magnet is situated in the pivoted position of the spinning unit 1 for cleaning the spinning rotor 14, see FIG. 3, hereinafter referred to as a cleaning position.

The sensor 101 of the position of the spinning unit 1 can consist of any well-known sensor or sensors adapted to give a signal at least about the start of the closing process of the spinning unit 1 from the cleaning position and/or a signal about the completed closing of the spinning unit 1.

The channel 13 supplying singling-out fibres from the singling-out device 12 ends in the spinning rotor 14 which latter is also a part of the spinning unit 1. In the opened position of the spinning unit 1, the axis of the spinning rotor 14 rests in its previous position, and the spinning rotor 14 just moves away from its drive which is not represented and at least for the cleaning period is set to rest.

The spinning rotor 14 is at the place of its greatest inner diameter fitted with a collecting groove 141 intended to receive during the spinning singled-out fibres forming a sliver band 32 which is in the spinning rotor 14 in a well-known way transformed into yarn 33 delivered from the spinning rotor 14 through a delivery tube 15 from which the yarn 33 is further led into a draw-off mechanism 4.

The draw-off mechanism 4 consists of a draw-off roller 41 and of a pressure roller 42 mounted on a pressure lever 43 and adapted to be tilted away from the draw-off roller 41 while during the spinning leaning against the circumference of the draw-off roller 41 and thus exerting pressure on the yarn 33 passing during the spinning between the pressure roller 42 and the draw-off roller 41. The pressure lever 43 is by means of a first tie-rod 431 coupled with a first control means 432 interconnected with the control unit A and made for instance as an electromagnet.

Situated between the outlet opening of the delivery tube 15 of the yarn 33 coming from the spinning unit 1 and the draw-off mechanism 4 is a yarn quality and presence monitor 5 through which the yarn 33 is led and which is also interconnected with the control unit A.

The yarn 33 is led from the draw-off mechanism 4 via a monitor 6 of yarn 33 presence and via a well-known yarn distribution mechanism 7 into a winding mechanism 8 containing a through-type drive roller 81 onto which there is in a well-known manner pressed a winding bobbin 82 whose tube 83 is fixed in arms 84 of a bobbin holder adapted in a well-known manner to be tilted out of the contact with the drive roller 81 of the winding mechanism 8 in order to interrupt the winding of the yarn 33, i.e., to lift the bobbin 82 and stop its rotary motion at the interruption of the spinning process. The arms 84 of the bobbin holder are adapted for the removal of the wound bobbin 82 and for the insertion of an empty tube 83 between the arms 84 of the bobbin holder. The monitor 6 of the yarn 33 presence is interconnected with the control unit A.

The arms 84 of the bobbin holder are by means of a second tie rod 841 coupled with a second control means 842 which is interconnected with the control unit A and is made for instance as an electromagnet.

Between the yarn 33 presence monitor 6 and the yarn distribution mechanism 7, the operating unit of the machine carries a deflecting member 9 for the yarn 33 coupled with a third control means 91 made for instance as an electromagnet, interconnected with the control unit A and in its deflected position deflecting the yarn 33 outside the yarn distribution mechanism 7 and creating totally or partially the reserve length of the yarn 33 required for the spinning-in.

The operating unit is also fitted with a spinning-in deflecting member 20 arranged between the outlet hole of the delivery tube 15 and the draw-off mechanism 4 or the yarn 33 quality and presence monitor 5. The spinning-in deflecting member 20 comprises a deflecting means 201 made for instance as an electromagnet, interconnected with the control unit A and serving to deflect the yarn 33 near the outlet hole of the delivery tube into its path prior to the spinning-in and to obtain by means of this deflection the spinning-in reserve of the yarn 33. In this embodiment, the distributing deflecting member is used only to define the yarn 33 path outside (away from) the yarn distribution mechanism 7 in the lifted position of the bobbin 82. One of the yarn 33 deflecting members 9, 20 can be used in case of need.

The control unit A can consist of a well-known not illustrated programmable processor and can be provided either on each operating unit of the rotor spinning machine, or it can be made as a control unit common to all operating units of a machine section and situated at each machine section since the processor can control a number of operating units simultaneously. It is also possible to situate the control units A for all operating units of a section at a predetermined place of the section. Also, the programmable processor can be located in a central control unit of the machine and used to control the spinning-in at the attended operating unit of the machine or at a number of operating units simultaneously.

The automated rotor spinning machine is built in the same manner and is in addition fitted with an attending device OZ adapted to stop at a chosen operating unit of the machine and fitted with means for communication with the control unit A as well as with means for carrying out the spinning-in preparatory steps both of yarn and of the spinning rotor. Before the spinning-in, the means for spinning-in yarn preparation lead the yarn into the means of the operating unit of the machine responsible for guiding and holding the yarn prepared to be spun-in.

The steps required for the spinning resumption on an operating unit of a rotor spinning machine can be divided into three groups, and more exactly, into steps for yarn spinning-in preparation, steps for spinning rotor spinning-in preparation, and final spinning-in steps.

The steps required for yarn spinning-in preparation involve at least the detection of the yarn end on a bobbin or the preparation of auxiliary yarn for spinning-in on an empty tube, unwinding and metering the yarn length required for spinning-in, leading the yarn into its spinning-in path on the operating unit of the rotor spinning machine in which the yarn is out of reach of the yarn distribution mechanism and outside the clamping contact with the rollers of the draw-off mechanism, producing the spinning-in yarn end and introducing it into the yarn delivery tube leading it out of the spinning rotor. The steps required for spinning rotor spinning-in preparation involve at least the the opening of the spinning unit to its cleaning position, cleaning of the stopped spinning rotor, and closing of the spinning rotor. The final spinning-in steps involve at least the resumption of the sliver feed into the singling-out device, fibre delivery from the singling-out device outside the spinning rotor for a time interval, the sinking of the spinning-in yarn end onto the collecting groove of the spinning rotor and starting the yarn draw-off and winding and, as the case may be, also the monitoring of the yarn quality and/or presence.

Upon the interruption of the spinning process on a rotor spinning machine, whether due to yarn rupture, completion of the winding of a predetermined yarn length on the bobbin, or for other reasons, the sliver feeding device 11 stops in a well-known manner, the bobbin 82 in process of winding moves out of contact with the drive roller of the winding device and stops.

In a semi-automatic rotor spinning machine the means of the operating unit involved in the spinning-in process move to their respective spinning-in positions due to their mutual mechanical or electrical interconnections.

When resuming the spinning on the operating unit, the operator, before closing the spinning unit, carries out a part of the yarn spinning-in preparation steps and a part of the spinning rotor spinning-in preparation steps. From the latter steps, the operator opens the spinning unit 1 and cleans the spinning rotor 14. From the former steps, the operator detects the yarn 33 end on the bobbin 82, unwinds and meters the yarn 33 length required for spinning-in, and inserts the yarn 33 in the means of the operating unit into its spinning-in path.

It can be stated as a general rule that the closing of the spinning unit 1 must be preceded by due spinning rotor spinning-in preparation steps, i.e., by the opening of the spinning unit 1 to its cleaning position and the cleaning of the spinning rotor 14. Yarn preparation steps can be carried out also after the closing of the spinning unit 1, and the step of inserting the spinning-in end of the yarn 33 into the delivery tube 15 must be carried out after the closing of the spinning unit 1.

After the above steps have been carried out, the operator proceeds to the step of closing the spinning unit 1. At the moment of the beginning of said closing operation, or during it, or at last at the moment of the completion of the spinning unit 1, the sensor 101 of the spinning unit position sends a signal directing the control unit A to start the yarn delivery from the singling-out device 12 outside the spinning rotor 14.

After the completion of the closing of the spinning unit 1, the spinning rotor 14 begins to rotate, the operator produces the spinning-in end of the yarn 33 and inserts it into the yarn delivery tube 15 into which it is sucked by underpressure, or the operator inserts into the yarn delivery tube 15 the spinning-in yarn end produced in advance. After being sucked into the yarn delivery tube 15, the spinning-in yarn end is held by the means of the operating unit at a predetermined distance from the collecting groove 141 of the spinning rotor 14 ready to be spun-in.

From the moment of the completed closing the final spinning-in steps follow in the hereinafter described sequence. First begins the sliver 31 feeding during which the fibres led into the singling-out device 11 are led from it outside the spinning rotor 14. At a predetermined time interval from the completed closing of the spinning unit 1, superior to the interval of the start of the sliver feeding, i.e., at a stage in which the spinning rotor 14 is expected to have reached its operative (or its spinning-in) speed, the fibre delivery outside the spinning rotor 14 is stopped, and the singled-out fibres are led from the singling-out device 11 into the spinning rotor 14 in which they are laid into a sliver band 32. At a predetermined time interval from the completed closing of the spinning unit 1, superior to the interval of the stop of the fibre delivery outside the spinning rotor 14, the yarn returns to the collecting groove 141 of the spinning rotor 14 where the spinning-in end of the yarn 33 is connected with the fibre band 32. At a predetermined time interval from the completed closing of the spinning unit 1, superior to the interval of the yarn return, the yarn draw-off and winding begins and the spinning process on the operating unit in question is thus resumed.

The final spinning-in steps started on the basis of the time interval elapsed from the moment of the completed closing of the spinning unit 1 can be reduced or increased according to the technological requirements of the spinning-in and spinning.

From the point of view of the synchronization of the individual spinning-in steps, it is immaterial whether the fibre delivery from the singling-out device 11 outside the spinning rotor 14 begins at the moment when the closing of the spinning unit 1 begins, goes on, or is completed, i.e., at the completed closing of the spinning unit 1 or immediately thereafter. The most suitable phase for starting the fibre delivery from the the singling-out device 11 outside the spinning rotor 14 is before the start of the spinning rotor 14 rotation, i.e., before the completed closing of the spinning unit 1, and the next suitable is the time interval as soon as possible after the start of the spinning rotor 14, i.e., at the moment of completed closing of the spinning unit 1 or as soon as possible after the completed closing of the spinning unit 1.

The sliver 31 feed can begin during the time when fibre delivery from the singling-out device 11 outside the spinning rotor 14 goes on in order to prevent initial damaged sliver fibres from entering the spinning rotor 14.

Figure 4A:
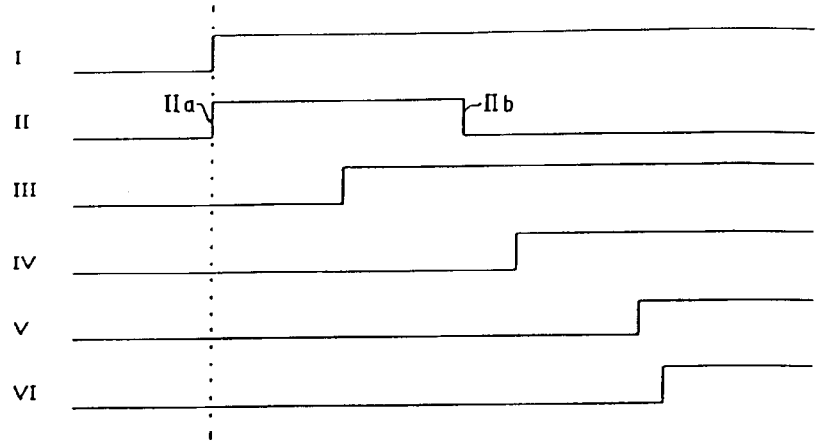
FIGS. 4*a*, 4*b*, 4*c* are diagrams of the control of final spinning-in steps from the closing process of the spinning unit.
Figure 4B:
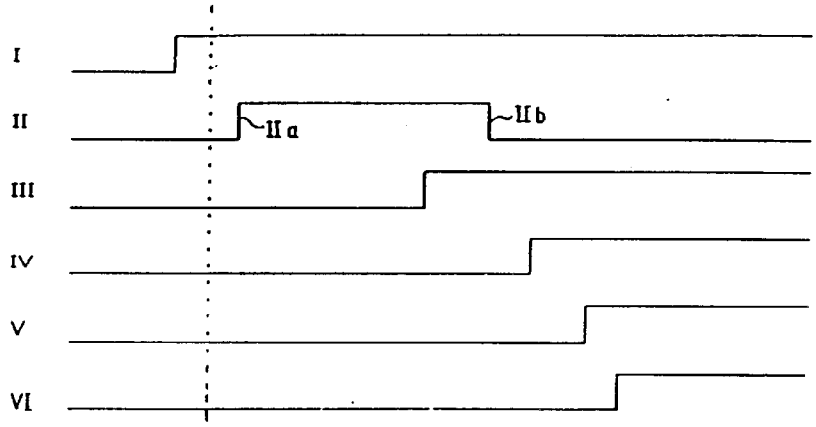
Figure 4C:
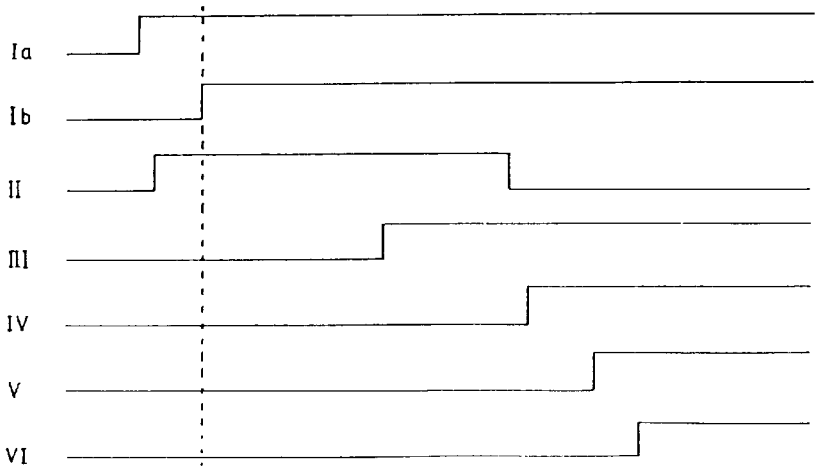

FIGS. 4*a*–4*c* show the time course of three examples of timing of at least some final spinning-in steps.

The embodiment shown in FIG. 4*a* uses the sensor 101 of the spinning unit 1 position emitting the signal Ib reporting the completed closing of the spinning unit 1. On the basis of this signal Ib reporting the completed closing of the spinning unit 1, the control unit A sends a command II for starting IIa the yarn delivery from the singling-out device 11 outside the spinning rotor 14. Besides, at predetermined intervals from the completed closing of the spinning unit 1, the control unit A emits the command III to start the fibre feeding into the singling-out device 11, the command II to stop the fibre delivery from the singling-out device 11 outside (away from) the spinning rotor 14, the command IV for returning the yarn onto the collecting groove 141 of the spinning rotor 14, and the command V for starting the yarn draw-off and the command VI for winding the yarn on the bobbin.

The embodiment shown in FIG. 4*b* uses the sensor 101 of the spinning unit 1 position emitting the signal Ia reporting the start of the closing of the spinning unit 1. On the basis of this signal Ia, the control unit A sends a command II for starting IIa the yarn delivery from the singling-out device 11 outside the spinning rotor 14. The length of the interval at which only the fibre delivery from the singling-out device 11 outside the spinning rotor 14 is carried out is superior to that of the preceding embodiment because none of the yarn spinning-in preparation steps have been carried out prior to the spinning-in so that the operator needs a longer time, after the completed closing of the spinning unit 1, to detect the yarn end on the bobbin, to meter the yarn length required for the spinning-in, to prepare the spinning-in yarn end, and to insert the yarn into its spinning-in path on the operating unit including its insertion into the delivery tube 15 into which it is sucked by the underpressure existing in the spinning rotor 14 and is ready to be spun-in. With an average skilled operator, said time required for spinning-in preparatory steps is known, and it is a matter of routine to set the start of the fibre delivery into the singling-out device 12 and in particular the end of the fibre delivery from the singling-out device 12 outside the spinning rotor 14 so as to obtain the feeding of the singled-out fibres into the spinning rotor 14 only after the yarn preparation for spinning-in. Further spinning-in steps follow the command to stop the fibre delivery from the singling-out device 12 outside the spinning rotor 14 at due technological intervals analogically to the embodiment of FIG. 4*a*, and they are timed for starting the closing operation on the spinning unit 1.

In the same manner as the embodiment of FIG. 4*b*, a not represented embodiment fitted with the sensor 101 of the position of the spinning unit 1 transmitting to the control unit A a signal on the course of the closing operation of the spinning unit 1 such as a magnetic sensor of the position in combination with a reed contact which tilts upon the beginning of the closing operation of the spinning unit 1 and emits a signal to the control unit A which uses it to start the fibre delivery from the singling-out device 11 outside the spinning rotor 14 and then the other final spinning-in steps.

The embodiment shown in FIG. 4*c* uses the sensor 101 of the spinning unit 1 position emitting the signal Ia reporting the start of the closing of the spinning unit 1 or the course of the closing operation of the spinning unit 1 and the signal Ib reporting the completed closing of the spinning unit 1. On the basis of the signal Ia, reporting the start of the closing of the spinning unit 1 or the course of the closing operation of the spinning unit 1, the control unit A sends a command II for starting IIa the yarn delivery from the singling-out device 12 outside the spinning rotor 14 before the completed closing of the spinning unit 1. The commands for carrying out further final spinning-in steps are emitted by the control unit A on the basis of the signal Ia reporting the completed closing of the spinning unit 1, while the command III for starting the feeding of the sliver into the singling-out device 12 or the command IIb to stop the fibre delivery from the singling-out device 12 outside the spinning rotor 14 is emitted by the control unit A with the required time lag so that the operator can have time enough for carrying out or finishing the spinning-in preparatory steps.

Another not illustrated alternative embodiment is fitted with the sensor 101 of the spinning unit 1 position emitting a signal on the start or on the course of the closing operation of the spinning unit 1 on whose basis the control unit A emits a command to deliver the fibres from the singling-out device 12 outside the spinning rotor 14 before the completed closing of the spinning unit 1. After the completed closing of the spinning unit 1, the operator carries out or finishes the steps of the yarn spinning-in preparation, and after they are finished (completed), the operator gives to the control unit A a signal reporting the readiness of the operating unit to resume the spinning on whose basis the control unit A gives a command to start the sliver feeding into the singling-out device and to stop the fibre delivery from the singling-out device outside the singling-out device and to start further final spinning-in steps.

In automated spinning machines, the steps of yarn spinning-in preparation and those of spinning rotor spinning-in preparation are carried out by the attending device OZ so that they can go on in parallel. The attending device OZ is shown in FIG. 1 in dash lines and is made in one of the well-known ways.

After the arrival and stop of the attending device in front of an operating unit in need of spinning resumption, the attending device OZ starts the steps of the yarn spinning-in preparation and the spinning rotor spinning-in preparations consisting in that the attending device OZ opens the spinning unit 1 to its cleaning position, cleans the spinning rotor 14, and closes the spinning unit 1. If the spinning unit is equipped with the sensor 101 of the spinning unit position, the sensor 101 emits the signal reporting the spinning unit 1 position in the same way as in the above described embodiments of the semi-automatic machine. Since the attending device OZ is fitted with means for communication with the attended operating unit or with its control unit A, the spinning unit need not be equipped with the sensor 101 of the spinning unit 1 position; the signal reporting the spinning unit position during its closing operation is emitted by the attending device OZ and is transmitted to the control unit A which controls the final spinning-in steps in the same manner as described above for semi-automatic rotor spinning machines.

It should be appreciated by those skilled in the art that various modifications and variations can be made to the embodiments of the invention described herein without departing from the scope and spirit of the invention as set forth in the appended claims and their equivalents.

What is claimed is:

1. A method of spinning-in yarn at a spinning unit of a rotor spinning machine, said method comprising:

steps of yarn preparation, steps of spinning rotor preparation, and final spinning-in steps;

said steps of yarn preparation comprising detection of a yarn end on a bobbin or preparation of an auxiliary yarn if spinning-in on an empty tube, unwinding and metering a yarn length required for the spinning-in, placing the yarn into a path in which it is unclamped by rollers of a yarn draw-off mechanism, and introducing the yarn end into a yarn delivery tube extending from a spinning rotor;

said steps of spinning rotor preparation comprising opening the spinning unit from its operative spinning position to a cleaning position, cleaning the spinning rotor in a stopped position thereof, and closing the spinning unit to its operative spinning position;

said final spinning-in steps comprising starting sliver supply to a fiber singling-out device, leading singled-out fibers from the singling-out device away from the spinning rotor for a predetermined time interval, bringing the yarn end into contact with a collecting groove in the spinning rotor, and starting yarn draw off and winding;

detecting closing of the spinning unit and generating a control signal corresponding thereto; and wherein at least one of said final spinning-in steps is synchronized with said closing of the spinning unit as a function of the control signal so as to commence at a set predetermined time interval measured from said closing step, said remaining final spinning-in steps being carried out in a timed relationship with the synchronized final spinning step.

2. The method as in claim 1, wherein said respective synchronized final spinning-in step is synchronize with completion of said closing step.

3. The method as in claim 1, wherein said respective synchronized final spinning-in step is synchronize with start of said closing step.

4. The method as in claim 1, wherein said respective synchronized final spinning-in step is synchronized to start with the time interval between start and completion of said closing step.

5. The method as in claim 1, wherein the yarn preparation steps and spinning rotor preparation steps are carried out manually, and the final spinning-in steps are automatically initiated by a control unit and carried out by operating components of the spinning unit.

6. The method as in claim 1, wherein the yarn preparation steps and spinning rotor preparation steps except the closing of the spinning unit step are carried out manually, and the final spinning-in steps are automatically initiated by a control unit and carried out by operating components of the spinning unit, said closing of the spinning unit started by a command issued by the control unit.

7. The method as in claim 1, wherein the yarn preparation steps and spinning rotor preparation steps are carried out by an attending device, and the final spinning-in steps are automatically initiated by a control unit and carried out by operating components of the spinning unit.

8. The method as in claim 1, wherein the yarn preparation steps and spinning rotor preparation steps except the closing of the spinning unit step are carried out by an attending device, and the final spinning-in steps are carried out by operating components of the spinning unit, the step of closing the spinning unit being started by a command from the attending device and the final spinning-in steps being started by the step of closing the spinning unit.

9. A method of spinning-in yarn at a spinning unit of a rotor spinning machine, said method comprising:

steps of yarn preparation, steps of spinning rotor preparation, and final spinning-in steps;

said steps of yarn preparation comprising detection of a yarn end on a bobbin or preparation of an auxiliary yarn if spinning-in on an empty tube, unwinding and metering a yarn length required for the spinning-in, placing the yarn into a path in which it is unclamped by rollers of a yarn draw-off mechanism, and introducing the yarn end into a yarn delivery tube extending from a spinning rotor;

said steps of spinning rotor preparation comprising opening the spinning unit from its operative spinning position to a cleaning position, cleaning the spinning rotor in a stopped position thereof, and closing the spinning unit to its operative spinning position;

said final spinning-in steps comprising starting sliver supply to a fiber singling-out device, leading singled-our fibers from the singling-out device away from the spinning rotor for a predetermined time interval, bringing the yarn end into contact with a collecting groove in the spinning rotor, and starting yarn draw off and winding; and wherein at least one of said final spinning-in steps is synchronized with said closing of the spinning unit so as to commence at a set predetermined time interval measured from said closing step, said remaining final spinning-in steps being carried out in a timed relationship with the synchronized final spinning step; and wherein at the start of said closing operation said step of leading singled-out fibers from the singling-out device away from the spinning rotor is started, and at the completion of said closing operation said step of starting sliver supply to the fiber singling-out device is started, said step of leading singled-out fibers away from the spinning rotor is stopped, and said step of bringing the yarn end into contact with the collecting groove in the spinning rotor and yarn winding are started.

10. A method of spinning-in yarn at a spinning unit of a rotor spinning machine, said method comprising:

steps of yarn preparation, steps of spinning rotor preparation, and final spinning-in steps;

said steps of yarn preparation comprising detection of a yarn end on a bobbin or preparation of an auxiliary yarn if spinning-in on an empty tube, unwinding and metering a yarn length required for the spinning-in, placing the yarn into a path in which it is unclamped by rollers of a yarn draw-off mechanism, and introducing the yarn end into a yarn delivery tube extending from a spinning rotor;

said steps of spinning rotor preparation comprising opening the spinning unit from its operative spinning position to a cleaning position, cleaning the spinning rotor in a stopped position thereof, and closing the spinning unit to its operative spinning position;

said final spinning-in steps comprising starting sliver supply to a fiber singling-out device, leading singled-out fibers from the singling-out device away from the spinning rotor for a predetermined time interval, bringing the yarn end into contact with a collecting groove in the spinning rotor, and starting yarn draw off and winding;

wherein at least one of said final spinning-in steps is synchronized with said closing of the spinning unit so as to commence at a set predetermined time interval measured from said closing step, said remaining final spinning-in steps being carried out in a time relationship with the synchronized final spinning step; and wherein during said closing operation said step of leading singled-out fibers from the singling-out device away from the spinning rotor is started, and at the completion of said closing operation said step of starting sliver supply to the fiber singling-out device is started, said step of leading singled-out fibers away from the spinning rotor is stopped, and said step of bringing the yarn end into contact with the collecting groove in the spinning rotor and yarn winding are started.

11. An open end spinning machine having individual spinning units for spinning yarn, comprising:

means for performing steps of yarn preparation, means for performing steps of spinning rotor preparation, and means for performing final spinning-in steps;

said steps of yarn preparation comprising detection of a yarn end on a bobbin or preparation of an auxiliary yarn if spinning-in on an empty tube, unwinding and metering a yarn length required for the spinning-in, placing the yarn into a path in which it is unclamped by rollers of a yarn draw-off mechanism, and introducing the yarn end into a yarn delivery tube extending from a spinning rotor;

said steps of spinning rotor preparation comprising opening the spinning unit from its operative spinning position to a cleaning position, cleaning the spinning rotor in a stopped position thereof, and closing the spinning unit to its operative spinning position;

said final spinning-in steps comprising starting sliver supply to a fiber singling-out device, leading singled-out fibers from the singling-out device away from the spinning rotor for a predetermined time interval, bringing the yarn end into contact with a collecting groove in the spinning rotor, and starting yarn draw off and winding;

each said spinning unit comprising a sensor disposed to detect the position of a cover of said spinning unit, said sensor in communication with a control unit, said control unit synchronizing said final spinning-in steps with closing of said cover detected by said sensor such that at least one of said final spinning-in steps is synchronized by said control unit with closing of the spinning unit so as to commence at a set predetermined time interval measured from the detected closing step, the remaining final spinning-in steps being carried out in a timed relationship with the synchronized final spinning step.

* * * * *